United States Patent [19]

Linquist et al.

[11] 4,353,164

[45] Oct. 12, 1982

[54] DRAW PUNCH

[75] Inventors: Wayne Linquist; Vernon Pearson, both of Rockford, Ill.

[73] Assignee: Ex-Cell-O Corporation, Troy, Mich.

[21] Appl. No.: 245,809

[22] Filed: Mar. 20, 1981

Related U.S. Application Data

[63] Continuation of Ser. No. 59,869, Jul. 23, 1979, abandoned.

[51] Int. Cl.[3] ..... B26F 1/00

[52] U.S. Cl. ..... 30/360

[58] Field of Search ..... 30/360

[56] References Cited

U.S. PATENT DOCUMENTS

| | | | |
|---|---|---|---|
| 1,721,007 | 7/1929 | Doherty et al. | 30/360 |
| 1,754,568 | 4/1930 | Nischan | 30/360 |
| 1,817,223 | 8/1931 | Abramson et al. | 30/360 |
| 2,237,069 | 4/1941 | Christenson | 30/360 |
| 3,269,011 | 8/1966 | Herrstrum | 30/360 |

FOREIGN PATENT DOCUMENTS

| | | | |
|---|---|---|---|
| 851760 | 10/1939 | France | 30/360 |
| 1415620 | 11/1975 | United Kingdom | 30/360 |

*Primary Examiner*—Stephen G. Kunin
*Assistant Examiner*—J. T. Zatarga
*Attorney, Agent, or Firm*—Edward J. Timmer

[57] ABSTRACT

This invention relates to a draw punch and its purpose is to punch a hole in sheet metal or the like, particularly in inaccessible places, such as an electrical outlet box or other terminal outlets. Moreover, the metal slug is split into two pieces and is removed easier.

6 Claims, 4 Drawing Figures

DRAW PUNCH

This is a continuation, of application Ser. No. 59,869, filed 7/23/79, now abandoned.

BACKGROUND OF INVENTION

This invention relates to a novel punch to be used with a draw punch for metal removal. Prior art, such as disclosed in U.S. Pat. No. 2,237,069 shows a draw punch having a die with a bolt axially aligned and threadedly engaged with a cutting head and a nut, such that as the nut is turned, the cutting head is urged to cut a slug of metal that is the same size as the inner diameter of the recessed portion of the die. Moreover U.S. Pat. Nos. 1,817,223, 2,221,904, and 3,269,011 show a typical metal punch and die means.

SUMMARY OF THE INVENTION

This invention relates to a draw punch having a punch or cutting head and a die. The punch or cutting head is designed with two opposed inclined planes intersecting at the center line of the punch.

The unique design of the punch or cutting head provides easier removal of the slugs in that the slug is split into two pieces.

DESCRIPTION OF THE INVENTION

Figure 1:
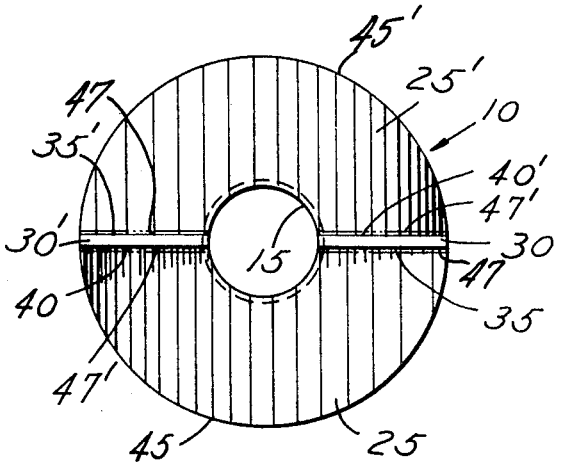
FIG. 1 is a top view of the punch or cutting head.
Figure 3:
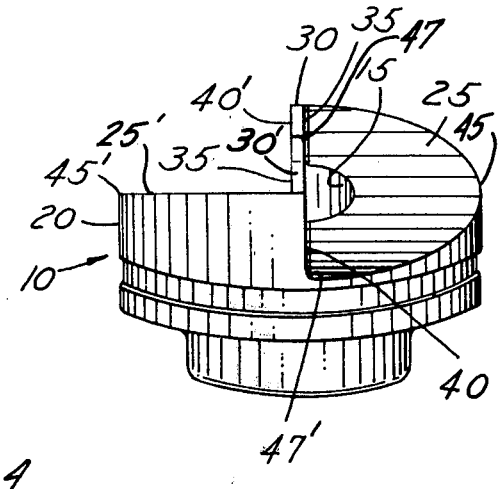
FIG. 3 is a general side oblique view of the punch, shown in the direction of the arrow 3 in FIG. 2.
Figure 2:
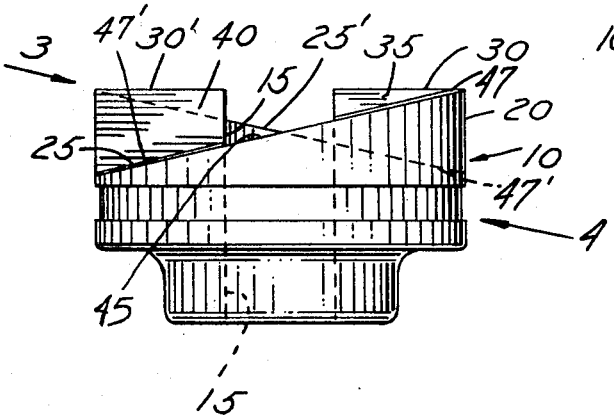
FIG. 2 is a general side elevational view of the punch or cutting head.
Figure 4:
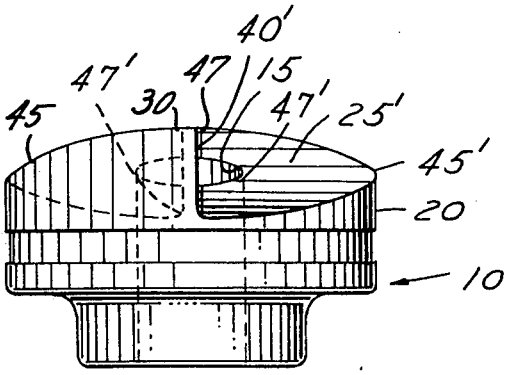
FIG. 4 is another general side view of the punch, shown in the direction of the arrow 4 in FIG. 2.

In the draw punch or cutter head illustrated in the drawing and described in detail herein, the die that is mated with the cutting head is not unique, in that it is a typical female die comprising a cylinder with one end closed and a recess comprising an inner diameter extending throughout almost the length of the die. The closed end of the cylindrical die includes a bore which is aligned with the threaded bore of the cutting head or punch. In particular, the invention relates to a cutting head 10, typically called a male punch, having a threaded bore 15 axially aligned throughout its longitudinal length. The outer diameter 20 of the cutting head 10 is adapted to fit the inner diameter of a female die, not shown. The cutting head 10 comprises a plurality of helical or inclined surfaces 25, 25' with respect to the top surface of rib members 30 and 30', as clearly shown in FIG. 2 and FIG. 4. Each inclined surface 25, 25' covers the semi-circular portion of the cutting head 10, and is symmetrical as viewed from the top of the tool in FIG. 1. In other words one inclined surface 25 is one-half of a single pitch screw or thread and the other inclined surface 25' is also one-half of a single pitch screw or thread. Each uppermost portion of the inclined surfaces 25, 25' end at the ribs 30, 30' respectively. The diameter of ribs 30 and 30' is the same diametral size as the cutting head, and is disjoined at the center by the diameter of bore 15. In other words, the ribs 30 and 30' extend diametrically from one edge 45 of the cutting head 10 to the other edge 45', except for the bore 15. Each rib 30, 31' has two uppermost lateral faces 35, 35' and 40, 40'. Lateral face 35 meets the uppermost radius juncture 47 of the inclined surface 25 whereas lateral face 40 meets the lowermost radius juncture 47' of inclined surface 25, 25'. The preferred embodiment of the drawing shows a pair of inclined surfaces 25 and rib 30, 30' at the radius juncture 47, 47' of each inclined surface, for the purpose to be described herein.

In operation, the male punch is placed opposite the female die member (not shown) with a metallic member to be cut in between both punch members. A bolt (not shown) is inserted through the bore of the female die (not shown) and through the hole of the metallic member previously drilled therethrough to allow such bolt to be inserted therein and threaded onto the threaded portion 15 of the punch die 10. A nut or other device is then adapted to squeeze together the male punch or cutting head and the female die. As the male punch is progressively moved against the metal, edge 45 cuts the diametral hole, and the diametral ribs 30, 30' separating each inclined surface 25, 25' is adapted to cut the metallic slug into two pieces. It is therefore apparent that the metallic slug that is cut out of the metal is split into two pieces by virtue of the ribs 30, 30' that is at the uppermost radius juncture 47 of the inclined or helical surfaces 25, 25' and the diameter of the metallic slug is cut by the edge 45, 45'. The radius juncture 47 is formed between the inclined surfaces 25, 25' and the lateral faces 40, 40' to provide strength and rigidity to the punch.

A preferred embodiment of the present invention has been described herein and illustrated in the accompanying drawings by way of example. However, it is to be understood that numerous modifications thereof may be made without departing from the broad spirit and scope of the invention as defined in the appended claims.

What is claimed is:

1. A male punch member adapted to be used with a cooperating female member to remove a slug in two pieces from a workpiece, comprising a body having an axial bore extending longitudinally therethrough for receiving means for moving said body inwardly and outwardly with respect to the female member, said body having cutting means at one end thereof, said cutting means being comprised a pair of inclined surfaces disposed around said bore and sloping upwardly in opposite directions from one another, said inclined surfaces each having a cutting edge on the entire edge of the outermost portions thereof, each inclined surface terminating at an uppermost end in a rib member extending laterally across said surface from said cutting edge to said bore and upwardly from said surface at said uppermost end, the rib members together forming lateral cutting means extending across said one end of said body except for said bore, whereby the cutting edges of said outermost portions cut the outer slug periphery and the rib members cut across the slug to split it into two pieces when the male member is forced inwardly of the female member with the workpiece therebetween.

2. The male punch die member of claim 1, wherein the body and cutting means thereon is cylindrically shaped.

3. The male punch die member of claim 1 wherein said rib members are the leading edges of said cutting means.

4. The male punch die member of claim 1 wherein said bore is threaded to removably secure a force applying member therein.

5. The male punch die member of claim 1 wherein the rib members oppose one another in the same general plane and are substantially of the same height.

6. A male punch member adapted to be used with a cooperating female member to remove an annular slug in two semicircular pieces from a workpiece with a circular hole therein, comprising a cylindrical body having an axial bore extending longitudinally therethrough aligned with the workpiece hole for receiving means for moving said body inwardly and outwardly with respect to the female member, said body having cutting means at one end thereof, said cutting means being comprised of a pair of identical helical surfaces sloping upwardly in opposite directions from one another with each surface overlying a semicircular portion of said one end, said helical surfaces each having a cutting edge on the entire edge of the outermost portions thereof and each terminating at an uppermost end in a rib member extending radially across said surface from said cutting edge to said bore in diametrically opposed relation to the other rib member and upwardly from said surface at said uppermost end, the rib members forming diametrical cutting means across said one end of said body except for said bore, whereby the cutting edges together cut a circular outer slug periphery and the rib members cut across the slug diameter to split the slug into two annular, semicircular pieces when the male member is forced inwardly of the female member with the workpiece therebetween.

* * * * *